United States Patent [19]

Niebrzydoski

[11] 4,124,661

[45] Nov. 7, 1978

[54] FUEL FLOW BALANCING APPARATUS

[75] Inventor: John L. Niebrzydoski, Florissant, Mo.

[73] Assignee: ACF Industries, Incorporated, New York, N.Y.

[21] Appl. No.: 854,653

[22] Filed: Nov. 25, 1977

[51] Int. Cl.[2] ..... F02M 7/24

[52] U.S. Cl. ..... 261/23 A; 261/121 B; 261/DIG. 69; 261/DIG. 74

[58] Field of Search ..... 261/121 B, 23 A, DIG. 69, 261/DIG. 74

[56] References Cited

U.S. PATENT DOCUMENTS

| | | | |
|---|---|---|---|
| 2,252,120 | 8/1941 | Ericson | 261/121 B |
| 3,648,987 | 3/1972 | Arikawa | 261/121 B |
| 3,675,906 | 7/1972 | Baldwin et al. | 261/23 A |
| 3,921,612 | 11/1975 | Aono | 261/121 B |
| 4,007,721 | 2/1977 | Regueiro | 261/121 B |
| 4,046,118 | 9/1977 | Aono | 261/121 B |
| 4,050,428 | 9/1977 | Masaki | 261/23 A |

*Primary Examiner*—Tim R. Miles

[57] ABSTRACT

A carburetor for an internal combustion engine has at least two air passageways through which air is drawn into the engine, at least one fuel circuit for each air passageway through which fuel is drawn from a source thereof into the passageway and mixed with air passing therethrough to produce an air-fuel mixture combusted in the engine. The amount of fuel flowing through each fuel circuit is a function of the sub-atmospheric air pressure level to which each fuel circuit is subjected. An improvement comprises apparatus for balancing the fuel flow in the fuel circuits with the pressure level in each fuel circuit being sensed, the pressure levels in the fuel circuits differing as a result of the flow characteristics thereof. Air is introduced into one of the fuel circuits to modulate the quantity of fuel flowing therethrough. The amount of air introduced into the one fuel circuit is controlled as a function of the difference between the sensed pressure levels in the fuel circuits whereby the quantity of fuel drawn through the one fuel circuit is adjusted until it substantially equals the amount of fuel drawn through the other fuel circuit so the resulting air-fuel mixtures produced in the air passageways are substantially equal.

17 Claims, 6 Drawing Figures

FUEL FLOW BALANCING APPARATUS

BACKGROUND OF THE INVENTION

The invention relates to fuel flow in multi-barrel carburetors and more particularly apparatus for balancing fuel flow through a carburetor's fuel circuits so the ratio of the air-fuel mixtures produced in each barrel is substantially equal.

In two barrel carburetors of the non-staged type, a problem exists in the manufacturing of the carburetor whereby both sides of the carburetor do not individually deliver air-fuel mixtures having the same air-fuel ratio for a given air flow. Further, current manufacturing practices are such that the ratio of the air-fuel mixtures delivered by each side are not measured, but rather, the ratio of the total air-fuel mixture delivered by the carburetor is measured with the mixture ratios produced by each side assumed to be equal. The problem is made more acute by the present state and federal emission standards and the emphasis on fuel economy. As various schemes, e.g. feedback control, are introduced into the carburetor system to control the air-fuel ratio of the mixture produced, so the catalytic converter devices now being used will operate most efficiently, the problem of equalization will become even more critical.

SUMMARY OF THE INVENTION

Among the several objects of the present invention may be noted the provision of a carburetor having two air passageways or barrels and a fuel circuit associated with each; the provision of such a carburetor having apparatus by which fuel flow through the fuel circuits for a given air flow is balanced so the air-fuel ratios of the mixtures produced in each barrel and supplied to the engine on which the carburetor is installed are substantially equal; and the provision of such a carburetor in which each barrel is supplied fuel through respective second fuel circuits and the apparatus also balances fuel flow through these second fuel circuits to obtain air-fuel mixtures whose air-fuel ratios are substantially equal.

Briefly, a carburetor of the present invention is for an internal combustion engine and has at least two air passageways through which air is drawn into the engine and at least one fuel circuit for each air passageway through which fuel is drawn from a source thereof into the passageway and mixed with air passing therethrough to produce an air-fuel mixture combusted in the engine, the amount of fuel flowing through each fuel circuit being a function of the sub-atmospheric air pressure level to which each fuel circuit is subjected. An improvement comprises apparatus for balancing the fuel flow in the fuel circuits and includes means for sensing the pressure level in each fuel circuit, the pressure levels in the fuel circuits differing as a result of the flow characteristics thereof. Air is introduced into one of the fuel circuits to modulate the quantity of fuel flowing therethrough. Means responsive to the sensed pressure levels controls the amount of air introduced into the one fuel circuit as a function of the difference between the sensed pressure levels in the fuel circuits whereby the quantity of fuel drawn through the one fuel circuit is adjusted until it substantially equals the amount of fuel drawn through the other fuel circuit so the resulting air-fuel mixtures produced in the air passageways are substantially equal. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
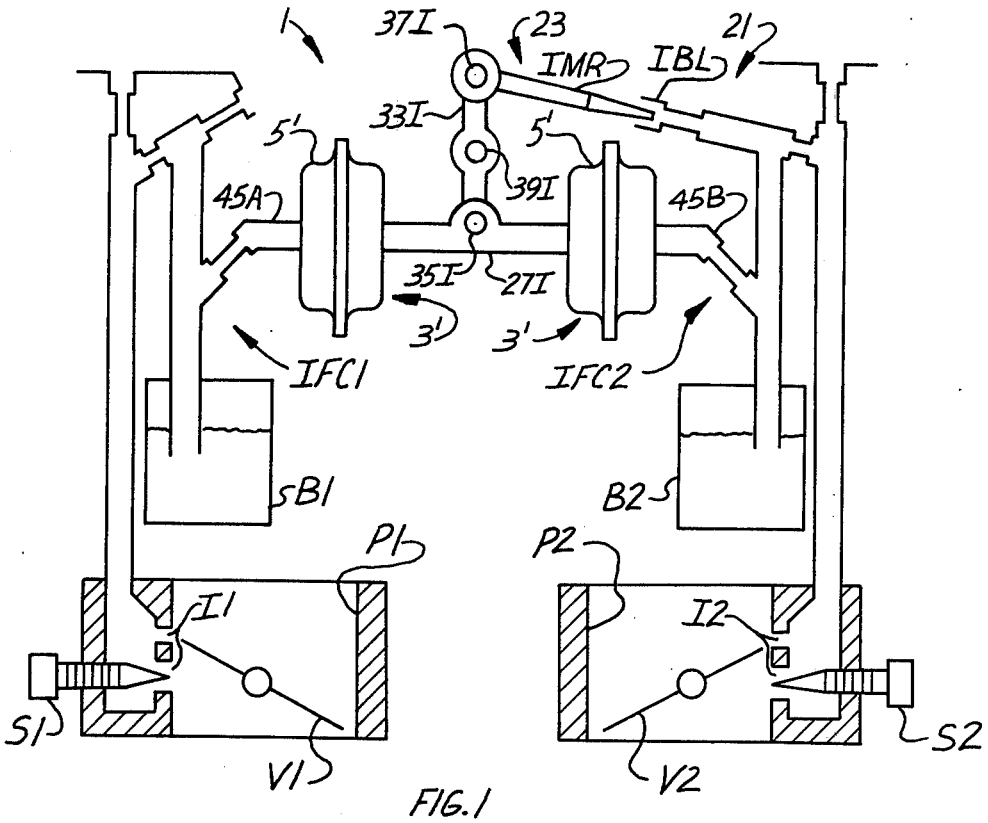
FIG. 1 is a diagrammatic representation of a carburetor having two air passageways, an associated fuel circuit for each air passageway and apparatus of the present invention for balancing the fuel flow in the fuel circuits.

Referring now to the drawings, a carburetor for an internal combustion engine (not shown) has two air passageways, P1 and P2 respectively, through which air is drawn into the engine. Each air passageway has at least one associated fuel circuit, generally indicated FC1 and FC2 respectively, through which fuel is drawn from a source thereof, e. g. fuel bowls B1 and B2 respectively. As shown in FIG. 1, fuel circuits IFC1 and IFC2 are the low speed or idle fuel circuits for a carburetor. The operation of carburetor idle fuel circuits is well known in the art with fuel being delivered to respective idle ports I1 and I2 when respective throttle valves V1 and V2 are substantially closed. Idle adjustment screws S1 and S2 respectively control the richness of the idle fuel mixture for the respective air passageways.

Figure 2:
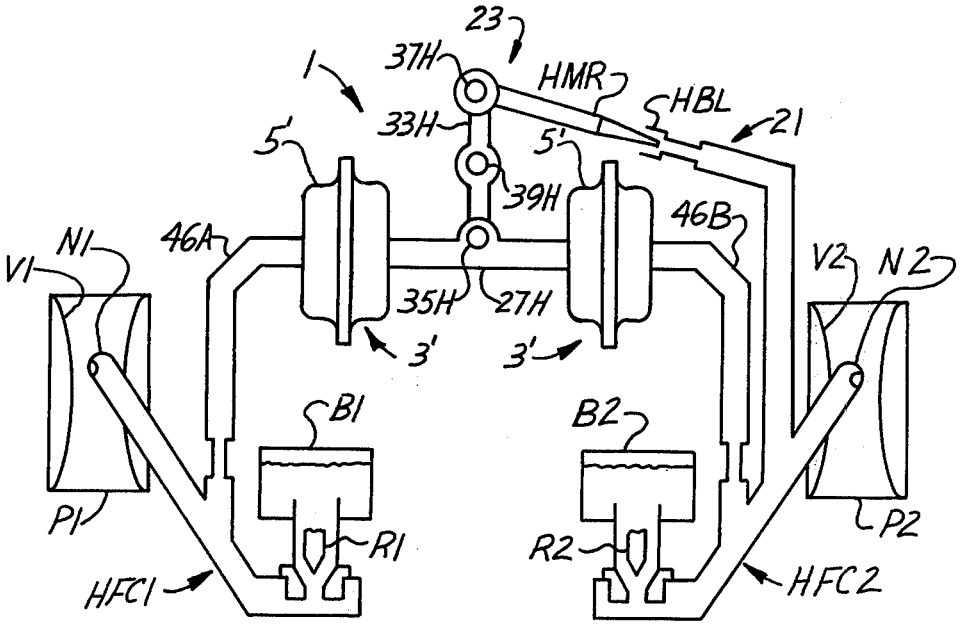
FIG. 2 is a diagrammatic representation of the carburetor of FIG. 1 illustrating a second fuel circuit associated with each air passageway and apparatus of the present invention for balancing the fuel flow in these second fuel circuits.

Preferably, each air passageway has a second associated fuel circuit, generally indicated HFC1 and HFC2 respectively. A portion of these fuel circuits are shown in FIG. 2, and they are the high speed fuel circuits through which fuel is drawn from fuel bowls B1 and B2 to respective nozzles N1 and N2 by the vacuum created at respective venturis V1 and V2 located in air passageways P1 and P2. Respective metering rods R1 and R2 are responsive to the opening and closing of their associated throttle valves to admit more or less fuel into the high speed circuits from respective fuel bowls B1 and B2. Again, the operation of carburetor high speed fuel circuits is well known in the art.

Regardless of whether fuel is flowing through the high speed or low speed fuel circuits of the carburetor, the fuel and air are mixed to produce an air-fuel mixture combusted in the engine. Further, the amount of fuel flowing through each fuel circuit is a function of the sub-atmospheric air pressure level to which the fuel circuit is subjected, a sub-atmospheric pressure level in each fuel circuit resulting from the movement of air through the air passageways. Ideally, the sub-atmospheric pressure level to which one low speed fuel circuit, for example, is subjected is the same as that to which the other low speed fuel circuit is subjected and the same amount of fuel is drawn through each circuit to its associated air passageway to mix with air with the resulting air-fuel ratios of the mixtures produced being equal. This, however, does not often occur. Rather, because of dimensional differences in the flow passages of the fuel circuits created during manufacturing, the lodgement of small particles carried by the fuel in the fuel passages, and the buildup of dirt or other particles, the flow characteristics of the fuel circuits differ and this affects the sub-atmospheric pressure level to which each circuit is subjected for a given air flow rate. Consequently, fuel flow through the fuel circuits differ as do the air-fuel ratios of the resulting mixtures produced in the respective air passageways. In effect, each side or barrel of the carburetor may be considered a separate carburetor whose operation is largely independent of the operation of the other side.

Figure 3:
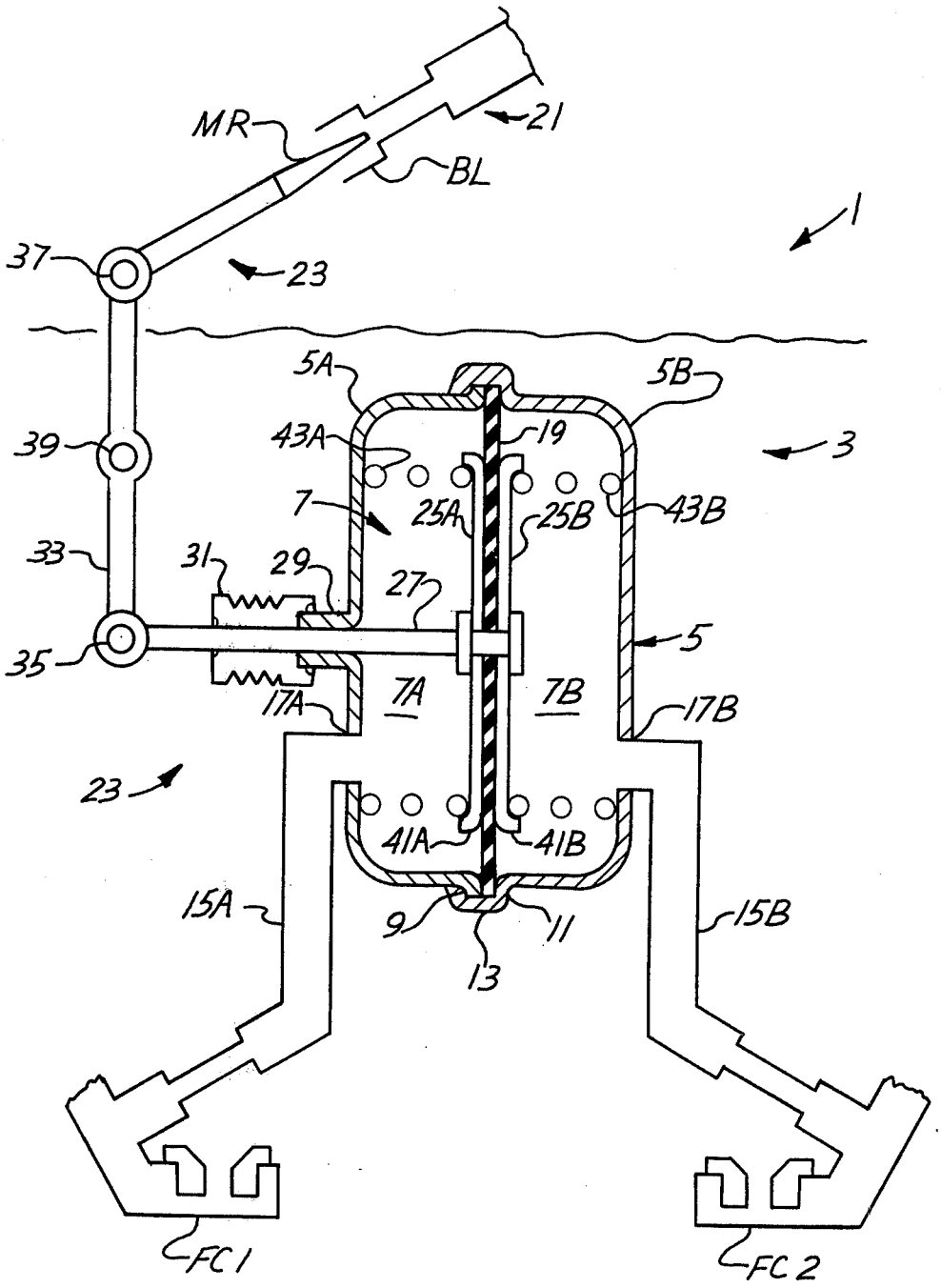
FIG. 3 illustrates a second embodiment of the fuel flow balancing apparatus of the present invention.

To overcome this problem, apparatus of the present invention, generally indicated 1, is included in a two-barrel carburetor to balance the flow of fuel in the high speed and idle speed fuel circuits. The apparatus includes means, generally designated 3, for sensing the the pressure level in each fuel circuit, the pressure level in the respective high speed or low speed fuel circuits differing, as noted, as a function of the flow characteristics of the fuel circuits. Pressure sensing means 3 comprises a differential pressure sensor 5 (see FIG. 3) in which a chamber 7 is formed by two cup-shaped housing sections 5A and 5B. Both sections are, for example, of thin-walled sheet metal construction with section 5A having an outwardly projecting lip 9 while section 5B has an outwardly projecting flange 11 with an upwardly turned rim 13. Lip 9 of section 5A seats against flange 11 of section 5B and rim 13 is crimped or otherwise pressed over lip 9 to form chamber 7. One side of chamber 7 is exposed to the sub-atmospheric pressure level in one of the fuel circuits and the other side of the chamber is exposed to the sub-atmospheric pressure level in the other associated fuel circuit. As shown in FIG. 3, a flow passage of each fuel circuit is tapped into at a point about the inlet into the flow passage from the fuel bowl associated with the fuel circuit. Restricted air passages 15A and 15B respectively communicate between the tapped flow passage and housing sections 5A and 5B. Each section has an opening, 17A and 17B respectively, formed therein for the pressure level present in each fuel circuit to also be present at a respective side of chamber 7. A flexible diaphragm 19 extends across chamber 7, effectively dividing the chamber into respective chambers 7A and 7B. Diaphragm 19 is, for example, a relatively thin disk of rubber or a synthetic resin material and the outer margin of the diaphragm is clamped between housing sections 5A and 5B. Consequently, diaphragm 19 is subjected to the pressure levels in each fuel circuit and flexes toward the side of chamber 7 exposed to the lower pressure level, the degree of flexing being proportional to the differential pressure between the two fuel circuits; i. e., the difference between the pressure level in fuel circuit FC1 and the pressure level in fuel circuit FC2.

Referring again to FIG. 3, means, generally designated 21, is provided for introducing air into one of the fuel circuits, this being accomplished by an air bleed BL. As shown in FIG. 1, means 21 comprises an air bleed IBL through which atmospheric air, for example, is introduced into idle fuel circuit IFC2, while in FIG. 2, means 21 comprises an air bleed HBL through which atmospheric air is introduced into high speed fuel circuit HFC2. By introducing air into the one fuel circuit, the quantity of fuel flowing therethrough can be modulated or varied.

Means, generally designated 23, is responsive to sensing means 3 to control the amount of air introduced into the one fuel circuit as a function the difference between the sensed pressure levels in the low speed circuits or the high speed circuits. Means 23 comprises an air metering rod MR having a diameter variable along its length. An air metering rod IMR is shown in FIG. 1 and an air metering rod HMR is shown in FIG. 2. Air metering rod MR is positioned in its associated air bleed BL to control the amount of air introduced into fuel circuit FC2. By controlling the amount of air introduced into fuel circuit FC2, the quantity of fuel flowing through the fuel circuit is adjusted until it equals the quantity of fuel flowing through the fuel circuit FC1; thus balancing or equalizing the fuel flow to both sides of the carburetor.

As shown in FIG. 3, diaphragm 19 is sandwiched between a pair of backing plates 25A and 25B respectively, the diaphragm and the backing plates each having a central opening in which is received on arm or rod 27. One end of arm 27 is secured to the diaphragm assembly and the diaphragm carries the arm as it flexes toward the sides of chamber 7. Housing section 5A has an outwardly projecting lip 29 through which arm 27 extends and a flexible boot 33 is inserted over the arm and the lip. The other end of arm 27 is attached to one end of a lever arm 33 by a pin 35 and the other end of lever arm 33 is attached to air metering rod MR by a pin 37. Lever arm 33 pivots about a point 39 to move air metering rod MR into or out of air bleed BL thereby to control the quantity of air introduced into the fuel circuit FC2. Backing plates 25A and 25B each have a lip, 41A and 41B respectively, to form a seat for respective coil springs 43A and 43B. The coil springs serve to eliminate all the forces acting on diaphragm 19 except the forces exerted thereon by the pressure levels in the fuel circuits.

In operation, diaphragm 19 flexes toward the side of chamber 7 exposed to the lower pressure level. This flexing produces movement of arm 27 and causes rotation of lever arm 33 about pivot 39. Depending upon the direction of rotation, the movement of the lever about its pivot either withdraws air metering rod MR out of air bleed BL or moves the air metering rod further into the air bleed. This changes the amount of air introduced into the fuel circuit through the air bleed, which in turn, changes the pressure level in the fuel circuit and serves to modulate the quantity of fuel flowing through the fuel circuit to its associated air passageway. This adjustment balances the quantity of fuel flowing through the fuel circuits so equal amounts of fuel are drawn through both. Since equal quantities of fuel now mix with equal quantities of air flowing through the respective air passageways, the air-fuel ratios of the mixtures produced are equal.

As shown in FIGS. 1 and 2, two differential pressure sensors 5' may be used for sensing the differential pressure between the two idle fuel or high speed fuel circuits. The construction of sensors 5' is similar to that of the sensor 5 previously described except that now the diaphragm in each sensor is subjected to the pressure level in only one of the fuel circuits. Thus as shown in FIG. 1, each sensor 5' respectively communicates with one of the low speed fuel circuits through respective restricted passages 45A and 45B. In the high speed circuits of FIG. 2, each sensor 5' respectively communicates with one of the fuel circuits through respective restricted passages 46A and 46B. The other side of each pressure sensor is exposed to a reference pressure level. For this purpose, the sensors are located in the air horn of the carburetor or, alternately, in the carburetor's fuel bowls. Thus the back side pressure on each diaphragm is equal and the amount of flexing of each diaphragm is a function of the differential pressure level between the reference pressure and the pressure in the fuel circuit with which the sensor is associated. The sensors 5' shown in FIGS. 1 and 2, are located in the air horn of a carburetor while the pressure sensors shown in FIGS. 3 and 4 are located in a fuel bowl of a carburetor.

An arm 27I or 27H respectively, has its ends supported by the diaphragms in the sensors 5' in the same manner that the one end of arm 27 is supported by diaphragm 19 of sensor 5 as previously described. Arm 27I or 27H is moved back and forth in response to the differential pressure level between the respective idle and high speed fuel circuits. Each arm is connected to a lever, 33I or 33H respectively, by respective pins 35I and 35H. The other end of each lever arm is respectively connected to air metering rods IMR and HMR by respective pins 37I and 37H. Each lever arm rotates about a pivot, 39I and 39H respectively.

The operation of the embodiment shown in FIGS. 1 and 2 may be understood by referring to FIG. 2 and considering the situation in which the pressure level in fuel circuit HFC2 is lower than that in fuel circuit HFC1. Because the pressure level in circuit HFC2 is lower, there is a greater vacuum in that circuit and more fuel is drawn from fuel bowl B2 to flow through circuit HFC2 than is drawn from fuel bowl B1 to flow through circuit HFC1. Further, since each sensor 5' is exposed to a reference pressure level, the degree of flexing of the diaphragm in the sensor sensing the pressure level in fuel circuit HFC2 is greater than that in the other sensor. This results in arm 27H moving toward the right as shown in FIG. 2. This rightward movement causes counterclockwise rotation of lever arm 33H about its pivot and air metering rod HMR is withdrawn from air bleed HBL. More air is introduced into fuel circuit HFC2 through the air bleed thus increasing the pressure level (lowering the vacuum) in the circuit. Less fuel is now drawn from fuel bowl B2 and this quantity is adjusted until the amount of fuel flowing through circuit HFC2 balances the quantity flowing through circuit HFC1. It will be understood that if the pressure level in circuit HFC2 had been higher than that in circuit HFC1, the reverse would have occurred with less air being introduced into fuel circuit HFC2 to increase the flow of fuel through the circuit until a balance is obtained.

Figure 4:
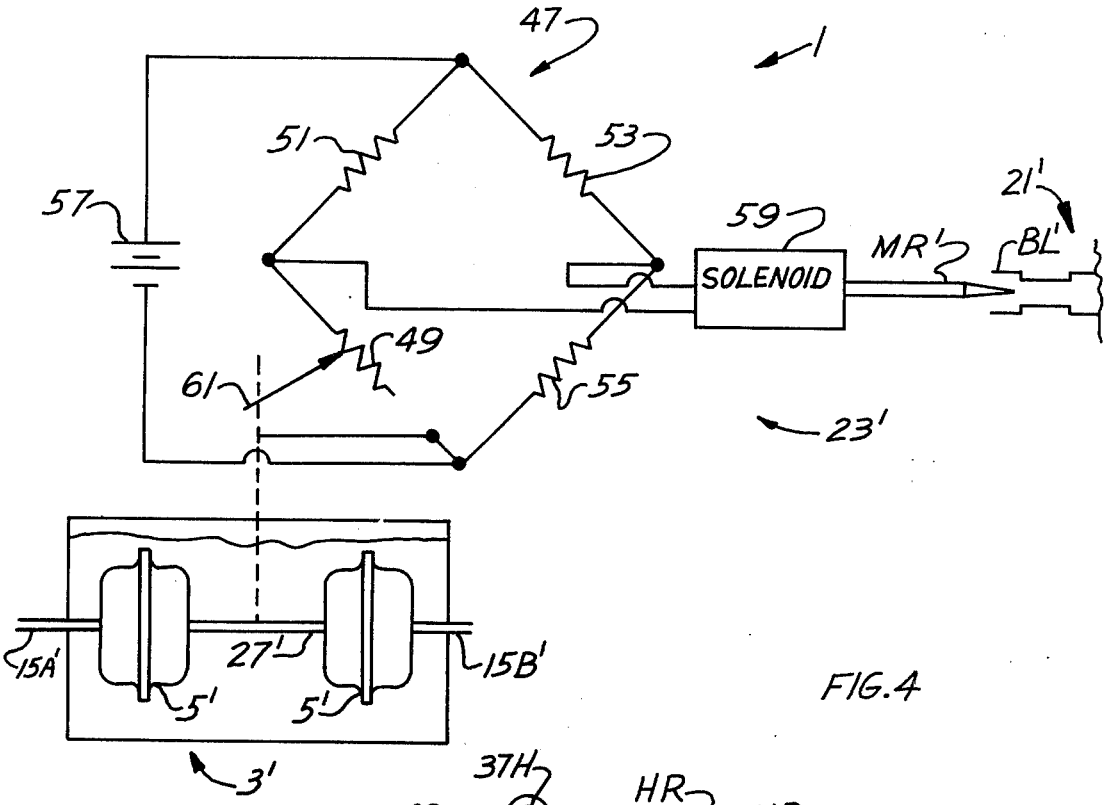
FIG. 4 illustrates a further embodiment of the fuel flow balancing apparatus of the present invention employing electrical circuitry.

Referring to FIG. 4, a third embodiment of the present invention is shown in which a positioning means 23' comprises an electrical resistance bridge, generally designated 47. One leg of the bridge includes variable resistance, which is a potentiometer 49 and the other legs of the bridge are comprised of fixed resistances 51,53 and 55. A source of electrical energy, a battery 57, is connected across the input terminals to the bridge and a solenoid 59 is connected across the bridge output terminals. Air metering rod MR' is movable by solenoid 59 to position the metering rod in an air bleed BL' in response to the bridge imbalance resulting from the pressure differential between the two fuel circuits. Wiper 61 of potentiometer 49 is movable by arm 27' which, as previously discussed, is connected between the diaphragms of the two differential pressure sensors 5'. The movement of arm 27' in response to the sensed differential pressure between fuel circuits moves wiper arm 61 and changes the resistance value of potentiometer 49, thus increasing or decreasing the bridge imbalance. This changes the amperage of the electrical current supplied to solenoid 59 to produce movement of air metering rod MR', by the solenoid, into or out of air bleed BL' to balance the flow rate of fuel between the two fuel circuits.

Figure 5:
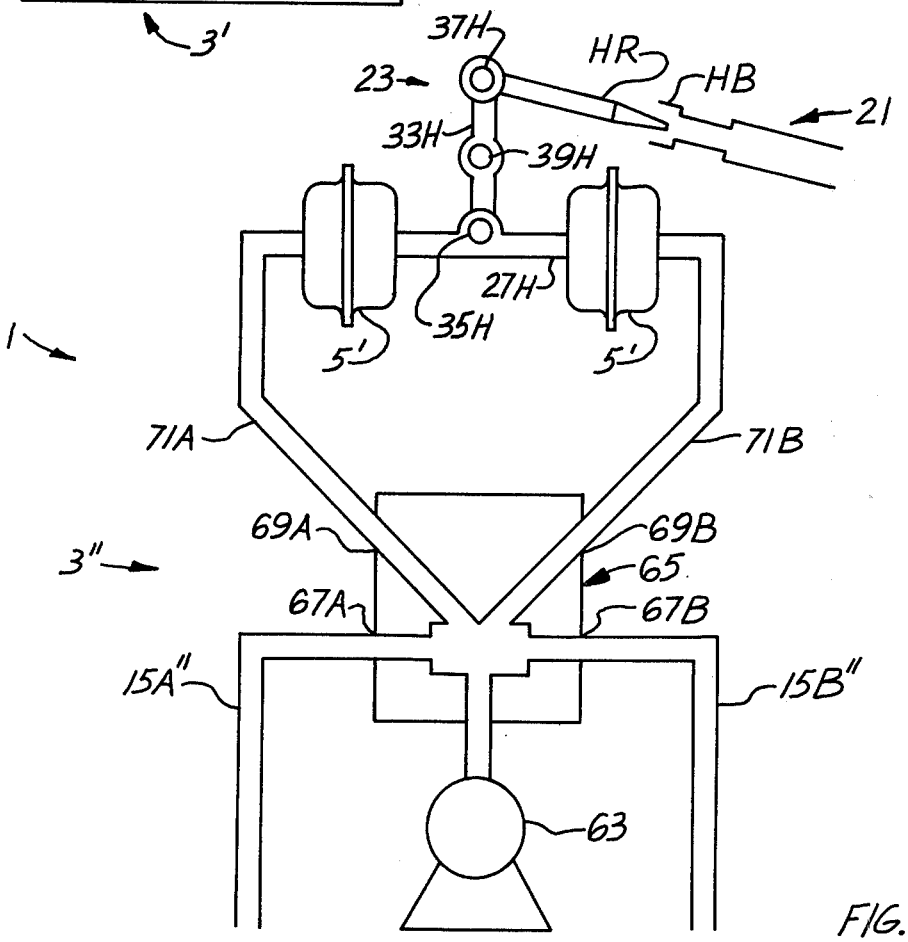
FIG. 5 illustrates yet another embodiment of the fuel flow balancing apparatus of the present invention employing a fluidic device.

A fourth embodiment of the apparatus of the present invention is shown in FIG. 5, in which pressure sensing means 3" includes a source of pressurized air or an air pump 63 and a fluidic amplifier 65 in fluid communication with the air pump. The fluidic amplifier has control inputs, 69A and 69B respectively, in communication with pressure sensors 5' via respective passages 71A and 71B. The pressure sensors, air bleed and positioning means are the same as previously described with respect to FIGS. 1 and 2, each pressure sensor being exposed to a reference pressure level.

In operation, pressurized air supplied to amplifier 65 from pump 63 is supplied to the differential pressure sensors. The pressure levels at the control inputs to the amplifier determine how much air is supplied to each. If, for example, the pressure level in passage 15A" is lower than that in passage 15B", the greater vacuum at control input 67A causes more air to flow into passage 71B, through outlet 69B, than into passage 71A. This is in accordance with principles well known in the art. The difference in the amount of air flowing through passages 71A and 71B is a function of the differential pressure between the fuel circuits. With more air directed through passage 71B than through passage 71A, arm 27H is moved to the left, as seen in FIG. 5, causing lever arm 33H to rotate clockwise about pivot 39H thereby inserting air metering rod MR into air bleed BL. This reduces the amount of air introduced into the fuel circuit associated with the air bleed thus increasing the quantity of fuel drawn through the fuel circuit until it equals the quantity drawn through the other fuel circuit. The result, again, is a balanced fuel flow and equalization of the air-fuel ratios of the mixtures produced in the carburetor air passages with which the fuel circuits are associated.

Figure 6:
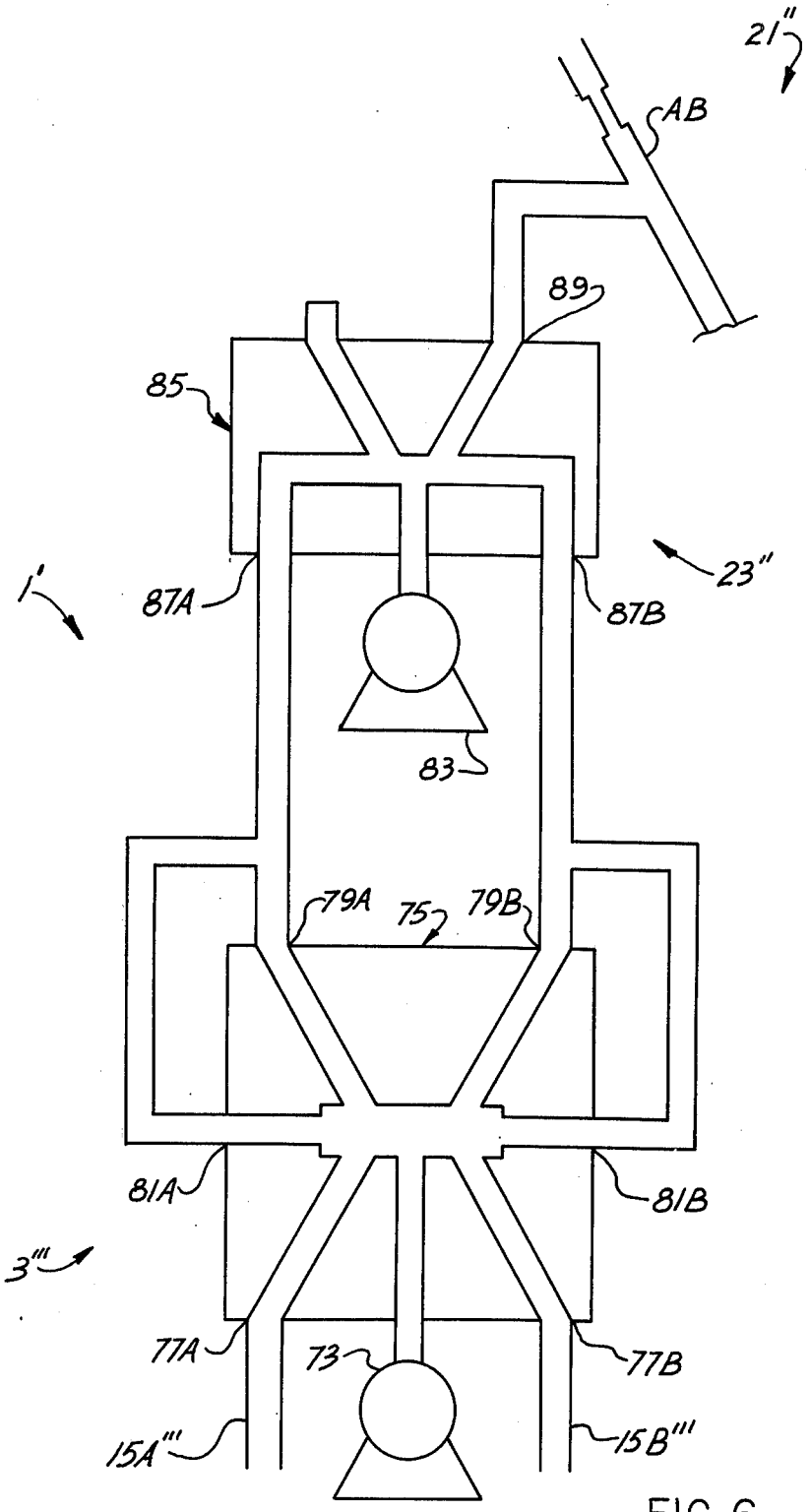
FIG. 6 illustrates another embodiment of the fuel flow balancing apparatus of the present invention employing fluidic devices.

Referring to FIG. 6, apparatus 1' of the invention comprises a pressure sensing means 3''' which includes a source 73 of pressurized air and a fluidic generator 75 in fluid communication with the pressurized air source. Generator 75 has respective control inputs 77A and 77B exposed to the sub-atmospheric pressure levels in the respective fuel circuits. Thus, an air passage 15A''' is in fluid communication with fuel circuit FC1 and control input 77A and an air passage 15B''' is in fluid communication with fuel circuit FC2 and control input 77B. The fluid generator has respective outputs 79A and 79B and each output is fed back to a respective control input 81A and 81B of the generator. As is well known, in the art generator 73 produces a series of fluid pulses at a repetition rate proportioned to the pressure differential between the fuel circuits.

Means, generally designated 21", comprises an air bleed AB through which atmospheric air is introduced into fuel circuit FC2. Means, generally designated 23"

includes a source of pressurized air 83 and a fluidic amplifier 85 in fluid communication with the pressurized air source. Amplifier 85 has respective control inputs 87A and 87B in fluid communication with respective outputs 79A and 79B of generator 75. Further, amplifier 85 has an output 89 in fluid communication with air bleed AB. In operation, amplifier 85 is responsive to the fluid pulses produced by generator 75 to supply pressurized air to air bleed AB to control the quantity of air introduced into fuel circuit FC2 thereby to equalize the sub-atmospheric pressure levels in the two fuel circuits.

In view of the above, it will be seen that the several objects of the invention are achieved and other advantageous results attained.

As various changes could be made in foregoing without departing from the scope of the invention, it is intended that all matter contained in the above description or shown in the accompanying drawings shall be interpreted as illustrative and not in a limiting sense.

I claim:

1. In a carburetor for an internal combusion engine, said carburetor having at least two air passageways through which air is drawn into the engine, at least one fuel circuit for each passageway through which fuel is drawn from a source thereof into said passageway and mixed with air passing therethrough to produce an air-fuel mixture combusted in said engine, the amount of fuel flowing through each fuel circuit being a function of the sub-atmospheric air pressure level to which each said fuel circuit is subjected, the improvement comprising: apparatus for balancing the fuel flow in said fuel circuits including means for sensing the pressure level in each fuel circuit, the pressure levels in said fuel circuits differing as a result of the flow characteristics thereof, means for introducing air into one of the fuel circuits to modulate the quantity of fuel flowing therethrough, and means responsive to the sensing means for controlling the amount of air introduced into said one fuel circuit as a function of the difference between the sensed pressure levels in said fuel circuits whereby the quantity of fuel drawn through said one fuel circuit is adjusted until it substantially equals the amount of fuel drawn through the other fuel circuit so the resulting air-fuel ratios of the mixtures produced in the respective air passageways are substantially equal.

2. The improvement as set forth in claim 1 wherein the pressure sensing means comprises at least one differential pressure sensor having means defining a chamber one side of which is exposed to the sub-atmospheric pressure level in one of the fuel circuits and the other side of which is exposed to the sub-atmospheric pressure level in the other fuel circuit and a flexible diaphragm extending across the chamber between the two sides and being subjected to the pressure levels in the two fuel circuits to flex in the direction of the side of the chamber exposed to the lower pressure level, the degree of said flexing being proportional to the differential pressure between the fuel circuits.

3. The improvement as set forth in claim 2 wherein the means for introducing air into one of the fuel circuits comprises an air bleed through which air is drawn from the atmosphere into the fuel circuit.

4. The improvement as set forth in claim 3 wherein the means responsive to the sensing means comprises an air metering rod having a diameter variable along its length and means for positioning said air metering rod in said air bleed, the position of said air metering rod being determined by the pressure differential between the fuel circuits.

5. The improvement as set forth in claim 4 wherein said positioning means comprises an arm carried by said diaphragm and movable therewith as said diaphragm flexes and means linking said air metering rod to said arm whereby the movement of the arm is transmitted to said air metering rod to adjust the position of said air metering rod in said air bleed and thereby control the amount of air introduced into said one fuel circuit.

6. The improvement as set forth in claim 5 wherein said pressure sensing means comprises a second differential pressure sensor, one side of the chamber in each sensor being exposed to a reference pressure level and the other side of each chamber being respectively exposed to the sub-atmospheric pressure level in one of said fuel circuits whereby the diaphragm in each sensor flexes toward one side of the respective sensor chamber an amount proportional to the differential between the pressure level in the respective fuel circuit and the reference pressure level.

7. The improvement as set forth in claim 6 wherein the ends of said arm are supported by the respective diaphragms in the pressure sensors and said arm moves therewith, the movement of said arm being a function of the amount of flexing of the diaphragms and proportional to the differential pressure between the fuel circuits.

8. The improvement as set forth in claim 4 wherein said positioning means comprises an electrical resistance bridge one branch of which includes a variable resistor whose value is determined by the differential pressure between the two fuel circuits as sensed by the sensing means, a source of electrical energy connected to the inputs of said bridge, and a solenoid connected across the outputs of said bridge, said air metering rod being movable by said solenoid and said solenoid positioning the air metering rod in said air bleed in response to the bridge imbalance resulting from the pressure differential.

9. The improvement as set forth in claim 8 wherein said pressure sensing means comprises a second differential pressure sensor similar in construction to the first said differential pressure sensor, one side of the chamber in each sensor being exposed to a reference pressure level with the other side of each chamber being respectively exposed to the sub-atmospheric pressure level in one of the fuel circuits and wherein said variable resistor comprises a potentiometer, said positioning means including means linking the wiper arm of said potentiometer to the respective diaphragms in the pressure sensors whereby the resistance value of said potentiometer is determined by relative deflection of the diaphragms in the pressure sensors.

10. The improvement as set forth in claim 7 wherein said pressure sensing means further includes a source of pressurized air and a fluidic amplifier in fluid communication with said pressurized air source, said fluidic amplifier having respective control inputs exposed to the sub-atmospheric pressure levels in the respective fuel circuits and respective outputs in fluid communication with the respective pressure sensors whereby the flow of pressurized air to one side of each respective chamber is controlled by the pressure differential between the two fuel circuits and the diaphragms in the respective pressure sensors are subjected to different air pressure levels, the difference between which corresponds to the pressure differential between the fuel circuits.

11. The improvement as set forth in claim 2 wherein said differential pressure sensor is positioned in a fuel bowl of the carburetor.

12. The improvement as set forth in claim 6 wherein said differential pressure sensors are positioned in an air horn of the carburetor and the reference pressure level to which each sensor is exposed is the pressure level in the air horn.

13. The improvement as set forth in claim 6 wherein said pressure sensors are submerged in a fuel bowl of the carburetor and the reference pressure level is the pressure level in the fuel bowl.

14. The improvement as set forth in claim 1 wherein fuel is drawn from said source to each said air passageway through a second fuel circuit and the apparatus includes means for sensing the pressure level in each said second fuel circuit, means for introducing air into one of the second fuel circuits to modulate the quantity of fuel flowing therethrough and means responsive to the last said pressure sensing means for controlling the amount of air introduced into said one second fuel circuit as a function of the difference in the sensed pressure levels in said second fuel circuits whereby the resulting air-fuel ratios of the mixtures produced in the air passageways are substantially equal.

15. The improvement as set forth in claim 1 wherein said pressure sensing means includes a source of pressurized air and a fluidic generator in communication with said pressurized air source, said fluidic generator having respective control inputs exposed to the subatmospheric pressure levels in the respective fuel circuits and said fluidic generator producing a series of fluid pulses at a repetition rate proportional to the pressure differential between said fuel circuits.

16. The improvement as set forth in claim 15 wherein the means for introducing air into one of the fuel circuits comprises an air bleed through which air is drawn from the atmosphere into said one fuel circuit.

17. The improvement as set forth in claim 16 wherein said means responsive to the sensing means comprises a source of pressurized air, and a fluidic amplifier in fluid communication with said pressurized air source, said fluidic amplifier having a control input in communication with an output of said fluidic generator and an output in fluid communication with said air bleed thereby to supply pressurized air to said air bleed in response to the fluid pulses produced by said fluidic generator, the air supplied to said air bleed controlling the pressure level in said one fuel circuit.

* * * * *